United States Patent [19]

Suekane

[11] 4,150,699

[45] Apr. 24, 1979

[54] WEFT YARN SENSOR

[75] Inventor: Junnosuke Suekane, Tokyo, Japan

[73] Assignee: Nissan Motor Company, Limited, Japan

[21] Appl. No.: 806,509

[22] Filed: Jun. 14, 1977

[30] Foreign Application Priority Data

Jun. 17, 1976 [JP] Japan ..... 51-70368

[51] Int. Cl.[2] ..... D03D 51/34

[52] U.S. Cl. ..... 139/370.2; 250/561; 250/571

[58] Field of Search ..... 139/336, 370.1, 370.2, 139/371; 250/559, 560, 561, 562, 227, 571

[56] References Cited

U.S. PATENT DOCUMENTS 3,853,408 12/1974 Kaalverink ..... 250/571
4,053,764 10/1977 Sierak et al. ..... 250/227

FOREIGN PATENT DOCUMENTS 2105559 8/1972 Fed. Rep. of Germany ..... 139/370.2

*Primary Examiner*—Henry S. Jaudon
*Attorney, Agent, or Firm*—Robert E. Burns; Emmanuel J. Lobato; Bruce L. Adams

[57] ABSTRACT

At least one of light projecting and receiving faces has a form which is elongate in the longitudinal direction of a weft yarn passed from the aperture of the sensor body to the outside of the aperture through the gap and is about equal to the thickness or size of the weft yarn in the direction of movement of the weft yarn passed through the gap.

11 Claims, 5 Drawing Figures

Fig. 1 PRIOR ART
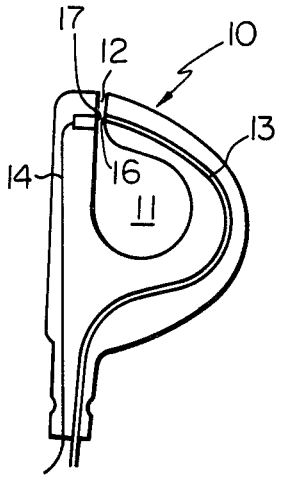
Fig. 2
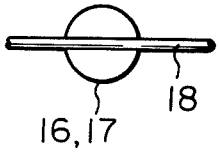
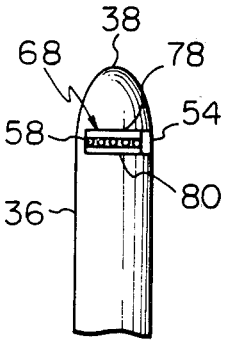
Fig. 4b
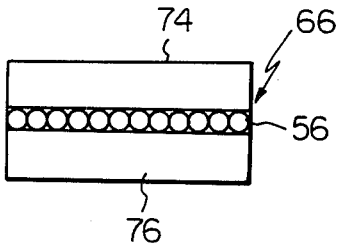
Fig. 4a

WEFT YARN SENSOR

BACKGROUND OF THE INVENTION

1. Field of the Invention

The present invention relates generally to a weft yarn sensor for use in weaving looms of an air jet shuttleless type and particularly to a weft yarn sensor for sensing whether a weft yarn has satisfactorily arrived at a predetermined position during insertion or not in weaving looms in each of which a weft yarn is inserted by employing a weft guiding comb including weft guiding members and spacers each guiding member of which has an aperture for guiding the weft yarn inserted and a gap for allowing the weft yarn to slip out of the aperture outside the guiding member and each guiding member and each spacer of which are alternately arranged and which are integrally pressed against each other by, for example, a through bolt and a nut.

2. Description of the Prior Art

As is already known in the art, a conventional weft yarn sensor of this type includes a sensor body 10 as shown in FIG. 1 of the accompanying drawings which has a form, an aperture 11 and a gap 12 about similar to those of the guiding member of the guiding comb. The sensor body 10 is provided with weft sensing means including first and second light transmitting means 13 and 14 which both are made of optical fibers such as, for example, glass fibers or clear plastic fibers and confront each other at the gap 12 of the sensor body 10 to form light projecting and receiving faces 16 and 17, respectively. The first light transmitting means 13 transmits light from a light source (not shown) to the light projecting face 16 and projects the light from the face 16 to the light receiving face 17. The second light transmitting means 14 transmits the light from the light receiving face 17 to a light receiving device (not shown) such as a phototransistor. When the weft yarn 18 passes through the gap 12 outside the aperture 11, it intercepts partially the light projected from the face 16 to the face 17.

The light projecting and receiving faces 16 and 17 both have been in the form of circles as shown in FIG. 2 of the accompanying drawings. The diameter of the circle of each of the faces 16 and 17 is considerably larger than the thickness or diameter of the weft yarn 18. For example, when the circle of each of the faces 16 and 17 has the diameter of 2 millimeter and the weft yarn 18 has the diameter of 50 denier as an example, since the maximum beam intercepted by the weft yarn 18 is merely one twentieth (1/20) of the whole beam projected to the face 17, the quantity of light transmitted from the face 17 to the light receiving device and accordingly the output of the light receiving device is slightly varied in accordance with interception and failure of interception of the light by the weft yarn 18. It has been difficult to sense such a slight change in the output of the light receiving device.

As a solution to this problem, it is considered to reduce the diameter of the circle of each of the faces 16 and 17 to a value about equal to the diameter of the weft yarn 18. However, this solution is undesirable since an excessively small quantity of light is fed to the light receiving device and the light receiving device such as a transistor is unable to respond to or be sensitive to such a fine light or a feeble light.

Furthermore, when the loom weaves fabrics of spun yarn made of short fibers such as cotton yarn, since a fly fluff is apt to be produced and it is in the form of about a circle, the fly fluff stuck to the light projecting and/or receiving faces 16 and/or 17 has intercepted the whole beam projected to the face 17 so that the conventional weft sensor has malfunctioned as if the weft yarn has been properly inserted notwithstanding that the weft yarn has not been properly inserted.

SUMMARY OF THE INVENTION

It is, therefore, an object of the invention to provide an improved weft yarn sensor in which a light receiving device is fed with a sufficient quantity of light to which it can respond when the light is not intercepted by the weft yarn and in which sensor at least one of light projecting and receiving faces has a greatly increased area covered at a time by the weft yarn so that the quantity of light transmitted to the light receiving device is greatly varied or reduced when the weft yarn intercepts light projected to the light receiving face.

It is a further object of the invention to provide an improved weft yarn sensor in which there is greatly reduced and possibility that the whole beam incident to the light receiving face is intercepted by a fly fluff.

These objects are accomplished by forming the at least one of the light projecting and receiving faces in about a rectangle which is fairly long in the longitudinal direction of the weft yarn passed through a gap of a sensor body and is considerably short in the direction of movement of the weft yarn passed through the gap or has a height about equal to or smaller than the diameter of the weft yarn.

BRIEF DESCRIPTION OF THE DRAWINGS

These and other features and advantages of the invention will become more apparent from the following detailed description taken in connection with the accompanying drawings in which:

FIG. 1 is a schematic view of a conventional weft yarn sensor as per the introduction of the present specification;

FIG. 2 is a schematic view of the form of each of light projecting and receiving faces of first and second light transmitting means forming part of the weft yarn sensor shown in FIG. 1;

FIGS. 4(*a*) and (*b*) are schematic views of light projecting and receiving faces of first and second light transmitting means forming part of the weft yarn sensor shown in FIG. 3, respectively.

DESCRIPTION OF THE SPECIFIC EMBODIMENT

Figure 3:
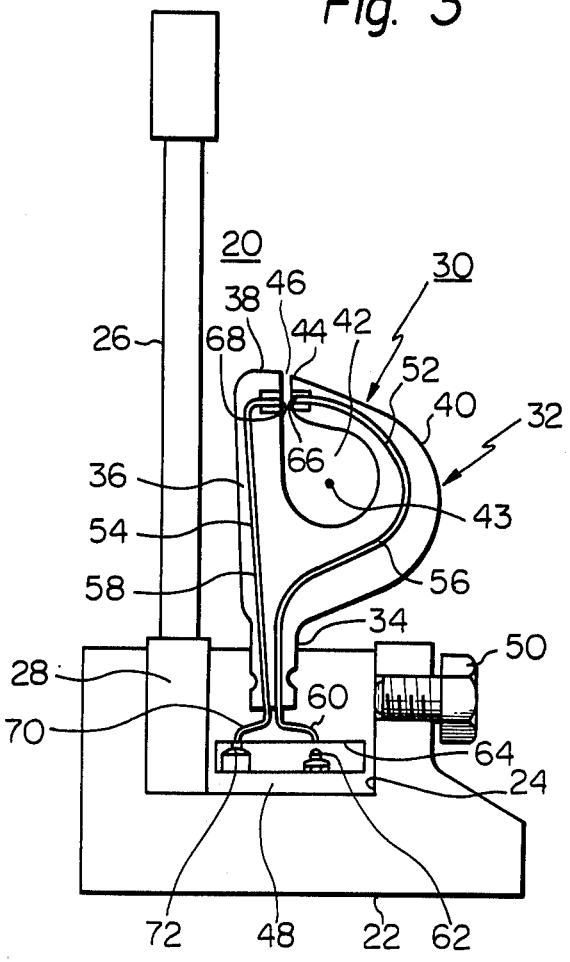
FIG. 3 is a schematic view of a preferred embodiment of a weft yarn sensor according to the invention.

Referring to FIG. 3 of the drawings, there is shown a typical example of a part of a weft yarn guiding and beating-up device of a fluid jet shuttleless weaving loom incorporating a weft yarn sensor according to the invention. The weft yarn guiding and beating-up device 20 includes a support beam 22 formed with a groove 24, a reed 26 having a lower end portion 28 received in the groove 24, and a weft yarn guiding comb (not shown).

The weft yarn sensor, generally designated by the reference numeral 30, comprises a sensor body 32 having a suitable thickness. The sensor body 32 comprises a lower portion or trunk portion 34, a first upper portion or upright arm portion 36 extending from the trunk portion 34 and having a free end 38, and a second upper portion or crescent arm portion 40 laterally branching off from a lower portion of the upright portion 36. The crescent portion 40 is curved toward a side of the free end 38 of the upright portion 36 so that a space or aperture 42 is formed between the upright and crescent portions 36 and 40. The aperture 42 forms part of a weft yarn passage through which a weft yarn 43 is passed when it is inserted into a shed of warp yarns (not shown). The crescent portion 40 has a free end 44 confronting and spaced from the side of the free end 38 of the upright portion 36 a suitable distance so that a gap or clearance 46 is formed between the side of the free end 38 and the free end 44. The gap 46 opens from the aperture 42 externally of the sensor body 32 for letting the weft yarn 43 to slip out of the aperture 42 outside the sensor body 32 through the gap 46.

The trunk portion 34 of the sensor body 32 is fixedly received in an attachment or boss 48 which is received in the groove 24 of the support beam 22 and is fixedly secured to the support beam 22 together with the lower end portion 28 of the reed 26 by suitable fastening means such as, for example, a bolt 50.

The weft guiding comb includes a plurality of weft guiding members (not shown) each of which has an external form and a thickness about identical with those of the sensor body 32. Each of the weft guiding memebers also has an aperture or space and a clearance about identical respectively with the space 42 and the clearance 46 of the sensor body 32. The weft guiding comb also includes a plurality of spacers (not shown) each of which is interposed between a different pair of weft guiding members adjoining each other so that one guiding member and one spacer are alternately arranged to adjoin each other. The guiding members and the spacers are fixedly received at their lower portions or trunk portions in the boss 48 by suitable fastening means such as, for example, adhesives to form a guiding comb. The apertures of the guiding members and the aperture 42 of the sensor body 32 are aligned with each other to form the weft yarn passage together with the aperture 42 of the sensor body 32. The weft guiding and beating-up device 20 thus assembled is swung into and away from its beat-up position in known manner during operation of the weaving loom. The weft yarn 43 having been passed through the weft passage of the guiding comb and the sensor body 32 during insertion is taken out from the weft passage outside the guiding comb and the sensor body 32 by way of the clearances of the guiding comb and the clearance 46 of the sensor body 32 by swinging movement of the device 20 into the beat-up position.

The sensor body 32 has a first continuous groove or passage 52 formed over the entire lengths of the trunk and crescent portions 34 and 40 and opening into the clearance 46 at the free end 44 of the crescent portion 40, and a second continuous groove or passage 54 formed over substantially the entire lengths of the trunk and upright portions 34 and 36 and opening into the clearance 46 at the free end 38 side of the upright portion 36. The passage 54 is turned at its upper portion toward the free end 44 of the crescent portion 40 and confronts at its upper end the upper end of the passage 52.

The weft yarn sensor 30 also comprises first and second light transmitting means 56 and 58 received respectively in the passages 52 and 54. The first and second light transmitting means 56 and 58 comprise first and second groups of optical fibers such as, for example, glass fibers, respectively, in this embodiment. The number of the glass fibers of each group is, for example, 12 as shown in FIG. 4(*a*) of the drawings in this embodiment. A lower portion 60 of the light transmitting means 56 extends from the lower end of the trunk portion 34 and is received in the attachment 48. The lower portion 60 confronts, at its lower end, a light source of a light projecting device 62 which is located in an aperture 64 formed in the attachment 48 and is fixedly secured to the attachment 48 so that the lower end forms a face receiving light projected from the light projecting device 62. The light transmitting means 56 and 58 terminate respectively in the free end 44 of the crescent portion 40 and the free end 38 side of the trunk portion 36 and confront each other. The upper end of the light transmitting means 56 forms a face 66 for projecting light, transmitted from the light receiving face, to the upper end of the light transmitting means 58 which end forms a face 68 for receiving light projected from the light projecting face 66. A lower portion 70 of the light transmitting means 58 extends from the lower end of the trunk portion 34 and is received in the attachment 48. The lower portion 70 confronts, at its lower end, a single light receiving device 72 such as, for example, a phototransistor which is located in the aperture 64 and is fixedly secured to the attachment 48 for receiving light transmitted from the light receiving face 68 to the lower portion 70. The light receiving device 72 is connected at an output terminal (not shown) thereof to a weft yarn sensing circuit (not shown).

Each of the light projecting and receiving faces 66 and 68 of the light transmitting means 56 and 58 has the form of about a rectangle having a length which is fairly long or elongate in a longitudinal direction of the weft yarn passed through the clearance 46 outside the aperture 42 and a width which is fairly short in the direction of movement of the weft yarn passed through the gap 46. Each of portions of the light transmitting means 56 and 58 excluding the light projecting and receiving faces 66 and 68 has a cross section in the form of about a circle. In this embodiment, the glass fibers 56 are arranged at the light projecting face 66 in alignment with each other in the longitudinal direction of the weft yarn passing through the clearance 46 to the outside of the aperture 42 to form a row of glass fibers 56 as shown in FIG. 4(*a*). Each of the glass fibers 56 has a thickness or size or diameter which is near or equal to or smaller than that of the weft yarn. The glass fibers 56 are fixedly secured to the sensor body 32 by interposing the row of the glass fibers 56 between rectangular thin boards 74 and 76 fixedly secured to the upper end of the crescent portion 40 on the upper and lower sides of the glass fibers 56 as shown in FIG. 4(*a*) by suitable fastening means such as, for example, adhesive so that the row of the glass fibers 56 is arranged parallel with the weft yarn passing through the gap 46. A portion of the glass fibers 56 other than the light projecting face 66 is bundled in the form of about a circle in cross section. The bundled glass fibers 56 are embedded in the groove 52 and are fixedly secured to the sensor body 32 by suitable fastening means such as, for example, adhesive. The glass fibers 58 are arranged at the light receiving face 68 in alignment with each other in the longitudinal direction of the weft yarn passing through the gap 46 to the outside of the aperture 42 to form a row of glass fibers 58 as shown in FIG. 4(*b*) of the drawings. Each of the glass fibers 58 has a diameter which is near or equal to or smaller than that of the weft yarn. The glass fibers 58 are fixedly secured to the sensor body 32 by interposing the row of the glass fibers 58 between rectangular thin boards 78 and 80 fixedly secured to the upper end 38 side of the upright portion 36 on the upper and lower sides of the glass fibers 58 as shown in FIG. 4(*b*) by suitable fastening means such as, for example, adhesive so that the row of the glass fibers 58 is arranged parallel with the weft yarn passed through the gap 46. A portion of the glass fibers 58 other than the light receiving face 68 is bundled in the form of about a circle in cross section. The bundled glass fibers 58 are embedded in the groove 54 and are fixedly secured to the sensor body 32 by suitable fastening means such as, for example, adhesive.

The weft yarn sensor 30 thus described is operated as follows:

When the weft yarn 43 is inserted into the warp shed during insertion, it is passed through the weft passage formed by the apertures of the weft guiding members and the aperture 42 of the sensor body 32 and is caught by catching warp yarns or catching means (not shown). The caught weft yarn 43 slips out of the weft passage through the gaps of the guiding members and the gap 46 of the sensor body 32 outside the guiding members and the sensor body 32 in the midst of movement of the device 20 into the beat-up position. In this instance, when the weft yarn 43 passes through the gap 46, it cuts off light projected from the light projecting face 66 of the light transmitting means 56 to the light receiving face 68 of the light transmitting means 58 after being transmitted from the light projecting device 62 to the face 66. Accordingly, light projected from the light transmitting means 58 to the light receiving device 72 is cut off to cause a change in the output generated by the device 72. The sensing circuit senses the change in the output of the device 72 to sense the weft yarn 43 having been satisfactorily or properly inserted. Conversely, when the weft yarn 43 has not been properly inserted during insertion, since the weft yarn 43 fails to pass through the gap 46 in the midst of movement of the device 20 into the beat-up position not to cause a change in the output generated by the light receiving device 72, the sensing circuit senses the weft yarn 43 having not been properly inserted. In the weft sensor 30, since the form of each of the light projecting and receiving faces 66 and 68 has a short side or a height about equal to or smaller than the diameter of the weft yarn 43 and a long side elongate parallel with the weft yarn 43, the weft yarn 43 cuts off concurrently and completely the whole light projected from the face 66 to the face 68 when it passes through the gap 46. Accordingly, the quantity of light projected from the light transmitting means 58 to the light receiving device 72 and accordingly the output generated by the device 72 are greatly varied in accordance with arrival and failure of arrival of the weft yarn at a predetermined position. As a result, the sensing circuit surely senses the weft yarn having been properly inserted or not properly inserted.

It is desirable to locate the sensor body 32, for example, slightly inside of the farest end of the row of warp yarns or near the catching means or caught portion of the inserted weft yarn as much as possible for making the longitudinal direction of each of light projecting and receiving faces 66 and 68 parallel with the longitudinal direction of the weft yarn or for having the weft yarn, passing through the gap 46, concurrently or satisfactorily cover the whole lengths of the light projecting and receiving faces 66 and 68.

Although the invention has been described such that both of the light projecting and receiving faces 66 and 68 have a form of a rectangle, it is possible to form only the light projecting face 66 in a rectangle and to employ an image sensor, a diode array or a transistor array as light receiving means in lieu of the light transmitting means 58. Alternatively, it is possible to form only the light receiving face 68 in a rectangle and to directly embed a light source in the upper end of the crescent portion 40 as light projecting means in lieu of the light transmitting means 56.

It will be thus appreciated that the invention provides a weft yarn sensor in which both or either of light projecting and receiving faces confronting each other at the gap of a sensor body has a form which is elongate parallel with the weft yarn passed through the gap outside the aperture of the sensor body and is considerably short in the direction of movement of the weft yarn passed through the gap so that the quantity of light fed to a light receiving device and the beam intercepted by the weft yarn are greatly increased and whether the weft yarn has been properly inserted or not is surely sensed.

It will be further appreciated that the invention provides a weft yarn sensor in which the form of both or either of the light projecting and receiving faces has a height which is about equal to or smaller than the diameter of the weft yarn so that the variation in the quantity of light by interception by the weft yarn is further increased and success and failure of insertion of the weft yarn is further surely sensed.

It will be also appreciated that the invention provides a weft yarn sensor in which the form of the light projecting and/or receiving faces is elongate in the longitudinal direction of the weft yarn so that since the light projecting and/or receiving faces is merely partially covered by a fly fluff, the degree of reduction in the quantity of light intercepted by the weft yarn is greatly increased and accordingly the reliability of sensing the success and failure of insertion of the weft yarn is greatly increased.

Although the invention has been described as being applied to an air jet shuttleless weaving loom, a weft yarn sensor according to the invention can be used in or applied to various kinds of weaving looms of a fluid jet shuttleless type employing liquid such as water, a shuttle type, a rapier shuttleless type and a gripper type in which the weft yarn is inserted without employing a guiding comb, by employing a sensor body formed with an aperture 42 through which for example, a shuttle can be passed during insertion.

What is claimed is:

1. A weft yarn sensor for a weaving loom, comprising a sensor body formed with an aperture through which an inserted weft yarn is passed during insertion, said sensor body having a first face for projecting light, and a second face for receiving the light from said first face, said first and second faces confronting each other and defining therebetween a gap providing communication between said aperture and the outside thereof for allowing the weft yarn to pass from said aperture to the outside thereof, said second face having a length which is elongate in the longitudinal direction of the weft yarn passing from said aperture to the outside thereof through said gap and a width which is not greater than the diameter of the weft yarn in the direction of movement of the weft yarn passing through said gap, and a single light-receiving device connected to said second face.

2. A weft yarn sensor as claimed in claim 1, in which said second face has a width which is about equal to the diameter of the weft yarn.

3. A weft yarn sensor as claimed in claim 1, in which said second face has a width which is smaller than the diameter of the weft yarn.

4. A weft yarn sensor as claimed in claim 1, further comprising a plurality of optical fibers, said second face is formed of ends of said fibers, respectively, said fibers being arranged at said ends in alignment with each other in the longitudinal direction of the weft yarn passing from said aperture to the outside thereof.

5. A weft yarn sensor as claimed in claim 4, further comprising a second group of fibers, said first face is formed of ends of said second group of fibers, respectively, said second group of fibers being arranged at said ends in alignment with each other in the longitudinal direction of the weft yarn passing from said aperture to the outside thereof.

6. A weft yarn sensor as claimed in claim 1, in which said single light receiving device is a phototransistor.

7. A weft yarn sensor in combination with a weaving loom, comprising a sensor body formed with an aperture through which an inserted weft yarn is passed during insertion, said sensor body having first and second opposite portions confronting each other and defining therebetween a gap opening from said aperture to the outside thereof for allowing the weft yarn located in said aperture to pass therefrom to the outside thereof, light projecting means located at said first portion for projecting light from a light source to said second portion, and a plurality of single optical fibers supported by said sensor body for conducting the light projected to said second portion, said plurality of single optical fibers having respectively ends which are located at said second portion for receiving the light projected thereto, said plurality of single optical fibers being arranged at said ends in alignment with each other in the longitudinal direction of the weft yarn passing from said aperture to the outside thereof through said gap, each of said plurality of single optical fibers having a diameter which is not larger than that of the weft yarn passing through said gap.

8. A weft yarn sensor in combination with a weaving loom, comprising a sensor body formed with an aperture through which an inserted weft yarn is passed during insertion, said sensor body having a first portion for projecting light, and a second portion for receiving the light projected from said first portion, said first and second portions confronting each other and defining therebetween a gap opening from said aperture to the outside thereof for allowing the weft yarn to pass from said aperture to the outside, said first portion having a length which is elongate in the longitudinal direction of the weft yarn passing from said aperture to the outside thereof through said gap and a width which is not larger than the diameter of the weft yarn, passing through said gap, in the direction of the diameter of the weft yarn passing through said gap.

9. A weft yarn sensor in combination with a weaving loom, comprising a sensor body formed with an aperture through which an inserted weft yarn is passed during insertion, said sensor body having first and second opposite portions confronting each other and defining therebetween a gap opening from said aperture to the outside thereof for allowing the weft yarn to pass from said aperture to the outside thereof, a plurality of optical fibers supported by said sensor body for conducting light to said first portion, said plurality of optical fibers having ends respectively which are located at said first portion for projecting the light conducted thereto, said plurality of optical fibers being arranged at said ends in alignment with each other in the longitudinal direction of the weft yarn passing from said aperture to the outside thereof through said gap, each of said plurality of optical fibers having a diameter which is not larger than that of the weft yarn passing through said gap, and light receiving means located at said second portion for receiving the light projected thereto.

10. A weft yarn sensor as claimed in claim 9, in which said light receiving means comprises a second group of optical fibers supported by said sensor body for conducting the light projected to said second portion, said second group of optical fibers having ends respectively located at said second portion for receiving the light projected from said plurality of optical fibers, said second group of optical fibers being arranged at said ends in alignment with each other in the longitudinal direction of the weft yarn passing through said gap, and a single light receiving device connected to the other ends of said second group of optical fibers respectively for receiving the light conducted therefrom.

11. A weft sensor as claimed in claim 10 in which said single light receiving device is a photo transistor.

* * * * *